US006345171B1

(12) United States Patent
Suga

(10) Patent No.: US 6,345,171 B1
(45) Date of Patent: Feb. 5, 2002

(54) IMAGE FORMING APPARATUS AND A METHOD TO CONTROL PAPER CONVEYING SPEEDS IN IMAGE FORMING APPARATUS

(75) Inventor: Takayuki Suga, Tokyo (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/613,867

(22) Filed: Jul. 11, 2000

(51) Int. Cl.[7] ..... G03G 15/00
(52) U.S. Cl. ..... 399/396; 399/68
(58) Field of Search ..... 399/59, 396, 397, 399/68

(56) References Cited

U.S. PATENT DOCUMENTS 4,916,547 A 4/1990 Katsumata ..... 358/300
5,742,867 A * 4/1998 Kodama ..... 399/49
5,802,422 A * 9/1998 Hokari ..... 399/36
6,014,542 A * 1/2000 Hozumi et al. ..... 399/394

* cited by examiner

*Primary Examiner*—Quana M. Grainger
(74) *Attorney, Agent, or Firm*—Foley & Lardner

(57) ABSTRACT

In an image forming apparatus wherein toner images formed on photo-conductive drums are transferred on a sheet of paper conveyed on a transferring belt, belt registration marks written on the transferring belt and sheet of paper registration marks written on a sheet of paper are detected by a photo-sensor, and from this result of detection, a conveying speed difference among aligning rollers, the transferring belt and fixing rollers is detected. Using this detected conveying speed difference, the sheet of paper conveying speed of the aligning roller, transferring belt or fixing rollers is fed back and the sheet of paper conveying speeds of the aligning rollers, transferring belt and fixing rollers are controlled to almost the same speed.

15 Claims, 7 Drawing Sheets

IMAGE FORMING APPARATUS AND A METHOD TO CONTROL PAPER CONVEYING SPEEDS IN IMAGE FORMING APPARATUS

BACKGROUND OF THE INVENTION

1. Field of the Invention

The present invention relates to an image forming apparatus to obtain an image by transferring developer images formed on photo-conductive drums on a sheet of paper that is supported and conveyed on a transferring belt and a method to control paper conveying speeds in an image forming apparatus.

2. Description of the Related Art

In an electro-photographic image forming apparatus; for instance, a quadruple tandem full-color printer, a copying machine, etc. to obtain a full color image, an endless transferring belt is used to convey a sheet of paper, etc. to the transferring positions of respective photo-sensitive drums synchronizing with toner images in different colors formed on plural photo-conductive drums which are arranged in parallel. While a sheet of paper is passing the transferring positions on the transferring belt, toner images in different colors are transferred thereto in order from the photo-conductive drums and superposed each other.

On the other hand, at the upper stream side of the transferring belt, there are provided aligning rollers for feeding a sheet of paper to the transferring belt at a prescribed timing after once aligning the leading edge of a sheet of paper supplied from a paper feed cassette, etc. At the downstream side of the transferring belt, there are provided fixing rollers which convey a sheet of paper having a full color toner image formed by superposing plural toner images in different colors while clamping it and fixes it on the sheet of paper.

When conveying a sheet of paper by the aligning rollers, the transferring belt and the fixing rollers and transferring toner images on the sheet of paper, if the traveling speed Vt of the transferring belt is faster than the sheet of paper conveying speed Va of the aligning rollers, the conveying speed of the sheet of paper is accelerated to Vt from Va after the sheet passed through the aligning rollers. In other words, as the conveying speed of the sheet of paper changes (becomes fast) while it is being conveyed on the transferring belt, there are problems that remarkably deteriorate the quality of images because, for instance, a magnification of a transferring image changes or a color distortion is caused although it was intended to prevent a color distortion caused from blurring of transferred images by insuring transferring positions of respective colors by a sensor and adjusting the exposing timings.

Therefore, the sheet of paper conveying speed Va of the aligning rollers was so far set faster than the speed Vt of the transferring belt and as shown in FIG. 1, while the conveying force was receiving from the aligning rollers 2, a difference between both speeds was absorbed by slightly deflecting a sheet of paper 1 at the front of a photo-conductive drum 3 and the sheet of paper 1 was conveyed at the constant speed of Vt of a transferring belt 4 during the conveyance by the aligning rollers and after passing through the aligning rollers.

However, when a difference is provided between the speed Vt of the transferring belt 4 and the sheet of paper conveying speed Va of the aligning rollers 2, if a sheet of paper is long, an amount of deflection becomes large and the paper may be bent or if a sheet of paper is thick, the paper is not deflected satisfactorily or the transferring becomes poor because the paper is pushed by force on the transferring belt by the conveying force of the aligning rollers 2. Furthermore, as the force pushing the sheet of paper will be released when the trailing edge of the sheet of paper passed through the aligning rollers, the sheet of paper may cause a vibration and in turn the rotation of the drum becomes uneven and blurring may be caused. These defects may possibly deteriorate the printed quantity of a transferred image.

In addition, when a sheet of paper is conveyed, it may slip on the aligning rollers for the effect of the smooth surface and a thickness of the paper and an accurate conveying speed cannot be obtained. Normally, therefore, it is necessary to set the sheet of paper conveying speed Va of the aligning rollers rather large expecting a sliding. This may make the above defects further worse.

Further, when fixing toner images after transferred them, the transfer is still in operation on the trailing edge of a sheet of paper and according to a difference between the sheet of paper conveying speed by the fixing rollers and the conveying speed of the transferring belt, there is the possibility for the deterioration of the quality of a printed image likewise the above.

Accordingly, in an image forming apparatus that conveys a sheet of paper using a transferring belt, it is desirable to obtain a good transferred toner image by preventing a blurring and vibration when transferring an image by controlling the sheet of paper conveying speeds by the transferring belt, and the aligning rollers and fixing rollers which are provided before and behind the transferring belt.

SUMMARY OF THE INVENTION

An object of the present invention is to provide a highly reliable image forming apparatus that is capable of forming a good transferred image without causing blurring and color distortion by controlling the sheet of paper conveying speeds by a transferring belt, aligning rollers and fixing rollers, preventing blurring and vibration caused by change in the sheet of paper conveying speed while transferring an image.

The present invention provides an image forming apparatus comprising: image forming means for forming a developer image on an image carrier; image transferring means for transferring the developer image developed on the image carrier on an image receiving material; traveling means for traveling to convey the image receiving material toward the image carrier; aligning means for conveying the image receiving material to the traveling means synchronizing with the transfer of the developer image formed on the image carrier; fixing means for fixing the developer image on the image receiving material while conveying the image receiving material which already has the developer image transferred; writing means for writing prescribed inspection mark on the traveling means or the image receiving material conveyed by the aligning means using the image forming means; detecting means for detecting the inspection mark written on the traveling means and the inspection mark written on the image receiving material; and drive control means for controlling the drive of at least one of the traveling means, aligning means and fixing means.

Further, the present invention provides an image forming apparatus comprising: an image forming unit to form a developer image on a photo-conductive drum; a transferring device to transfer the developer image formed on the photo-conductive drum on an image receiving material; a transferring belt that is traveling to convey the image receiving material to the photo-conductive drum; an aligning roller to convey the image receiving material to the transferring belt synchronizing with the transfer of the developer image formed on the photo-conductive drum; a fixing roller to fix the developer image on the image receiving material while conveying the image receiving material that has the developer image transferred thereon; a writing device to write prescribed inspection mark on the transferring belt or the image receiving material that is conveyed by the aligning roller; a sensor to detect the inspection mark written on the transferring belt and the inspection mark written on the image receiving material; and a drive control device to control the drive of at least one of the transferring belt, the aligning roller and the fixing roller according to the result of detection by the sensor.

In addition, the present invention provides a method of controlling the sheet of paper conveying speeds in an image forming apparatus comprising the steps of: traveling a first conveying means to convey an image receiving material toward the image carriers at a prescribed speed; feeding the image receiving material to the first conveying means while conveying the image receiving material at a prescribed speed by a second conveying means; further conveying the image receiving material conveyed by the first conveying means by a third conveying mean; writing a prescribed conveying inspection mark on the first conveying means; writing a prescribed image receiving material inspection mark on the image receiving material that is fed by the second conveying means; detecting the conveying inspection mark written on the first conveying means; detecting the image receiving material inspection mark written on the image receiving material; and controlling at least one of the traveling speed of the first conveying means, the image receiving material conveying speed of the second conveying means and the conveying speed of the third conveying means based on the detection result of the conveying inspection mark and the detection result of the image receiving material inspection mark.

DETAILED DESCRIPTION OF THE PREFERRED EMBODIMENTS

Figure 1:
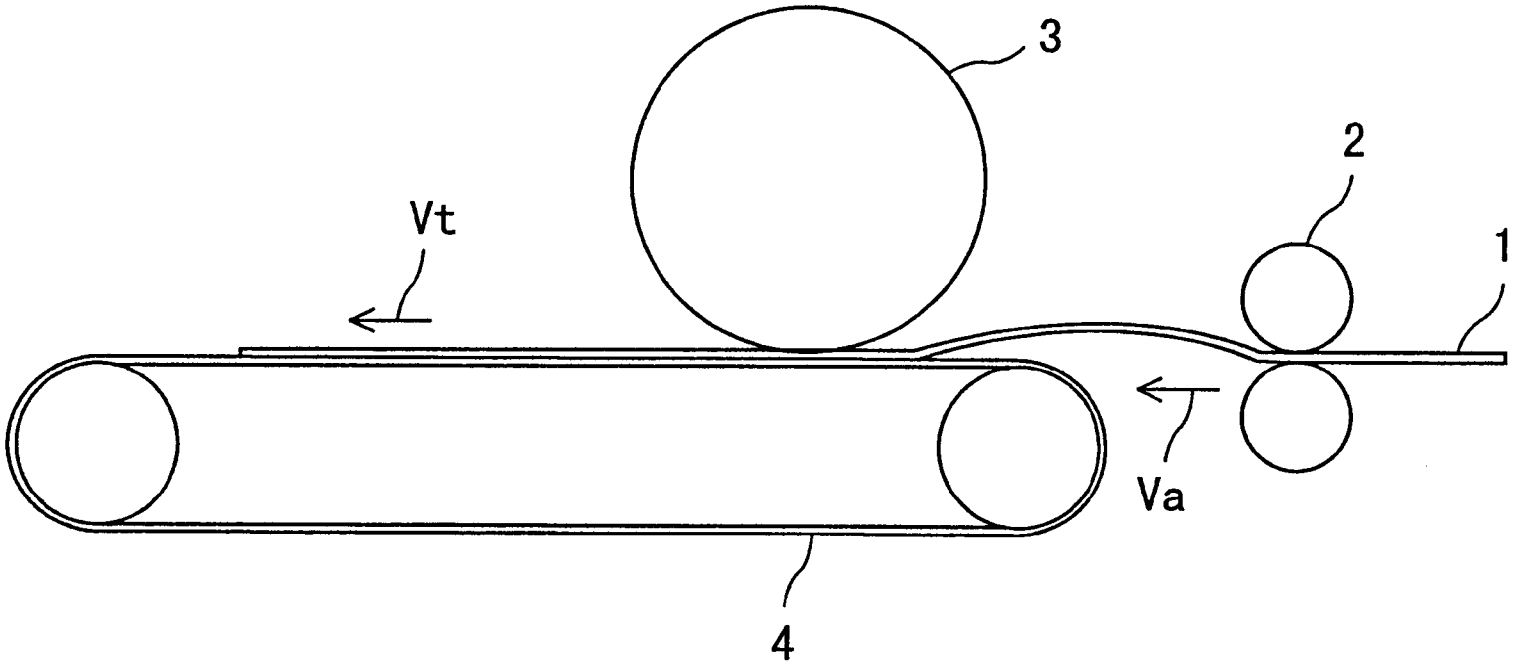
FIG. 1 is an explanatory diagram showing a deflection of a sheet of paper being conveyed by aligning rollers of a conventional image forming apparatus.
Figure 2:
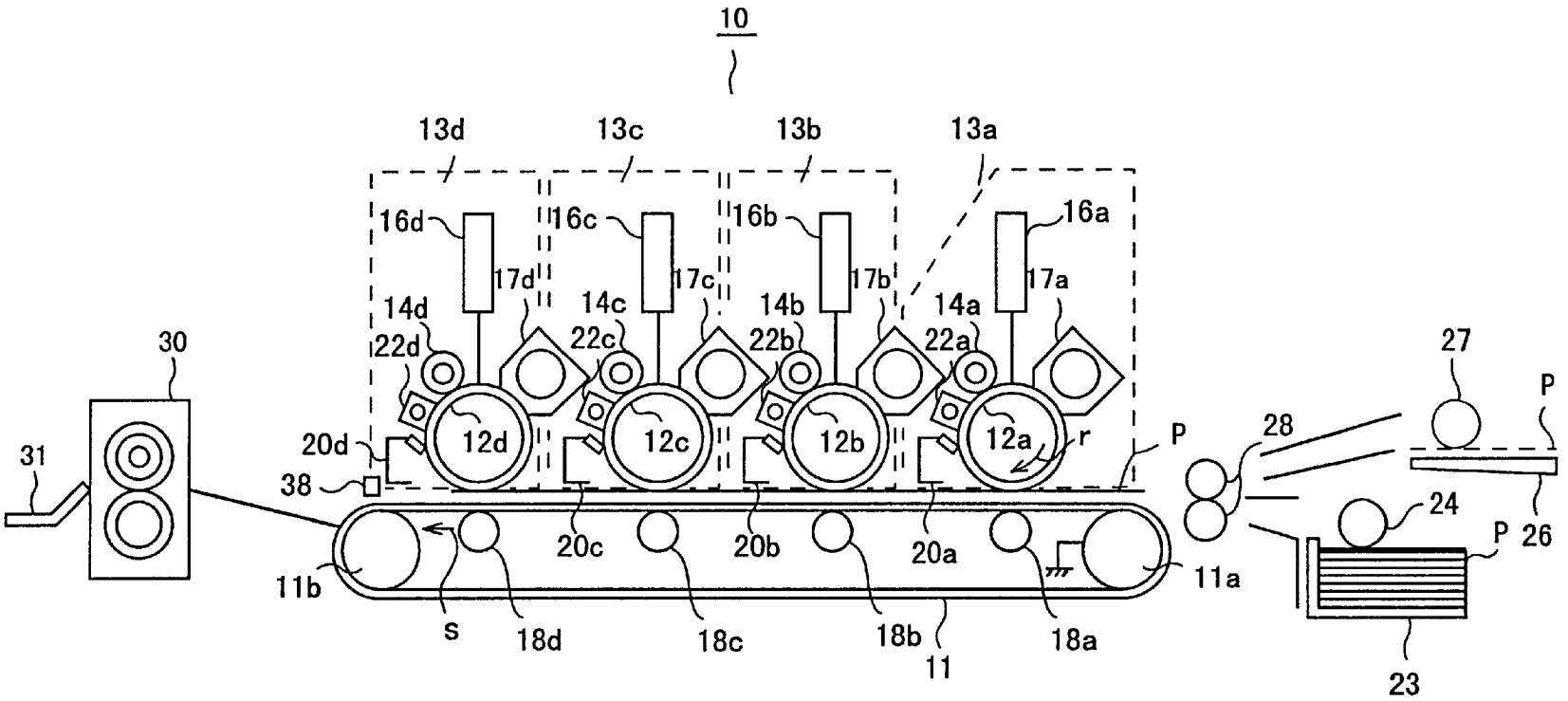
FIG. 2 is a block diagram schematically showing an image forming unit applied to an embodiment of the present invention.

Preferred embodiments of the present invention will be described below in detail taking the attached drawings as examples. FIG. 2 is a schematic block diagram showing an image forming mechanism 10 of a color printer, a full-color copying machine, etc. that are embodiments of an image forming apparatus of the present invention. Along a transferring belt 11 of the image forming mechanism 10, a first through fourth image forming units 13*a*–13*d* which form images using yellow (Y), magenta (M), cyan and black (BK) toners on photo-conductive drums 12*a*–12*d*, which are image carriers, are arranged in parallel. The transferring belt 11 is put over a driving roller 11*b* and an idling roller 11*a*.

Around the photo-sensitive drums 12*a*–12*d*, there are provided charging rollers 14*a*–14*d*, which are image forming units to form toner images on the photo-conductive units 12*a*–12*d*, exposing devices 16*a*–16*d*, which form electrostatic latent images by separating document image information into yellow, red, blue and black colors and exposing the photo-conductive drums 12*a*–12*d* and developing devices 17*a*–17*d*, which develop the electrostatic latent images formed on the photo-conductive drums 12*a*–12*d* using yellow (Y), magenta (M), cyan (C) and black (BK) developers. Further, at the downstream side of the developing devices 17*a*–17*d* of the photo-conductive drums 12*a*–12*d*, there are provided charge applying rollers 18*a*–18*d* which are transferring rollers, cleaning devices 20*a*–20*d* and charge eliminating rollers 22*a*–22*d* via the transferring belt At the upper stream side of the transferring belt 11 of the image forming mechanism 10, there are provided aligning rollers 28 which feed a sheet of paper P that is supplied from a paper feed cassette 23 or a manual feed tray 26 by a pickup roller 27 to the transferring belt 11 side at a timing that the leading edge of the paper agrees with the trailing edge of a toner image formed on the photo-conductive drum 12*a*. Further, at the downstream side of the transferring belt 11 of the image forming mechanism 10, fixing rollers 30 and a receiving tray 31 are provided.

Figure 3:
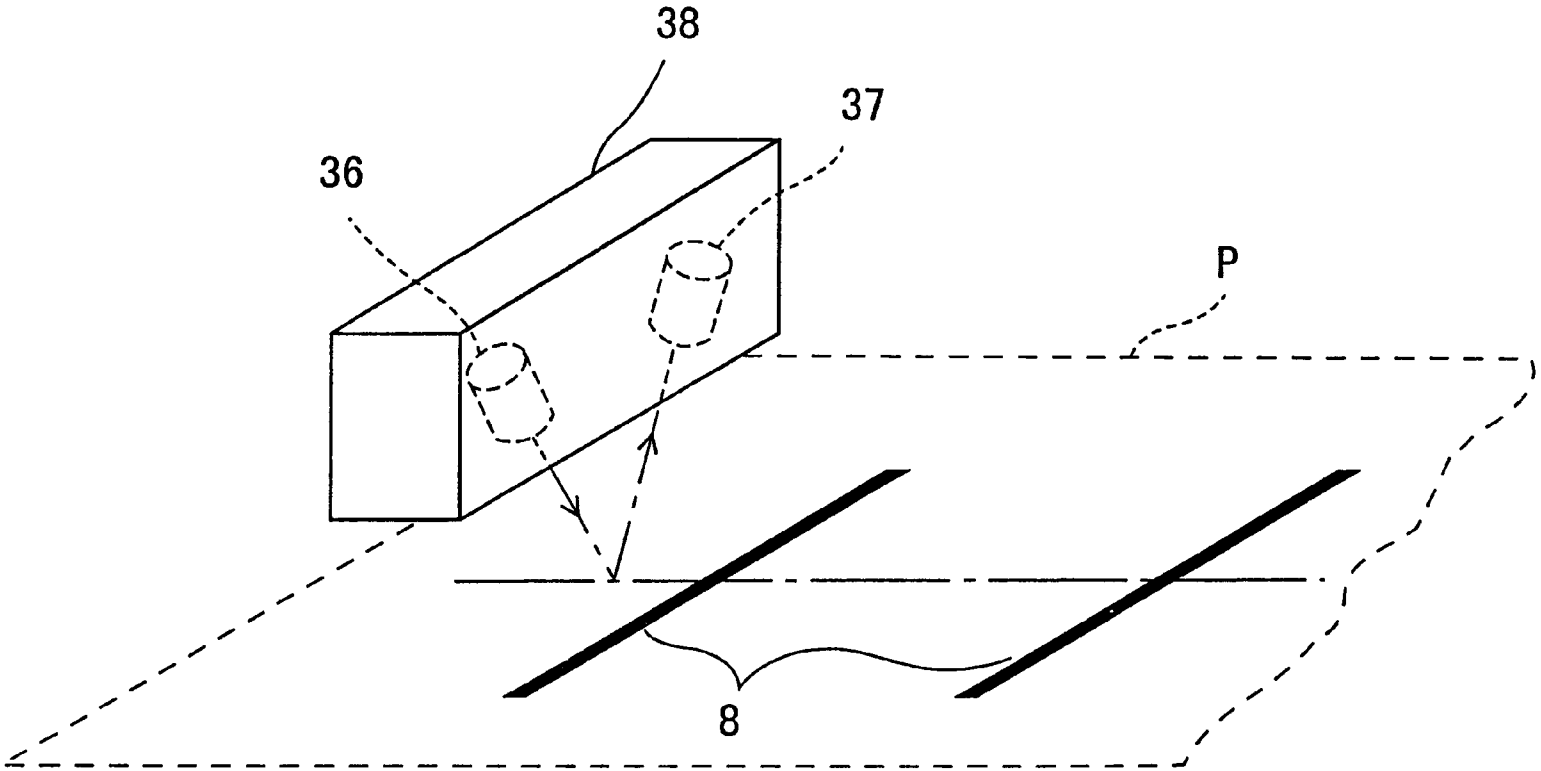
FIG. 3 is a perspective view schematically showing a photo-sensor applied to the embodiment of the present invention.

Further, at the upper part of the transferring belt 11 after passing the image forming units 13*a*–13*d*, there is provided a photo-sensor 38 which has a light emitting element 36 and a light receiving element 37 of which focal points are focused on the surface of the transferring belt 11 as shown in FIG. 3 and the output is varied depending on the reflecting state of the surface of the transferring belt. This photo-sensor 38 is capable of detecting the reflecting output of the transferring belt 11 itself, the output regarding the presence of a toner image formed on the transferring belt 11 and the output regarding the presence of the toner image 8 on a sheet of paper P.

The photo-sensor 38 reads color registration marks (not shown) printed on the transferring belt 11 by the image forming units 13*a*–13*d* in order to correct distortions of transferred images of the quadruple tandem image forming units 13*a*–13*d*. Further, the photo-sensor 38 reads the belt registration marks 42, 43, the registration marks 46, 47 of a first sheet of paper, and the registration marks 48, 49 of a second sheet of paper, all of which will be described later, printed on the transferring belt 11 in order to detect the conveying speeds of a sheet of paper P by the transferring belt 11, the aligning rollers 28 and the fixing rollers 30.

Figure 4:
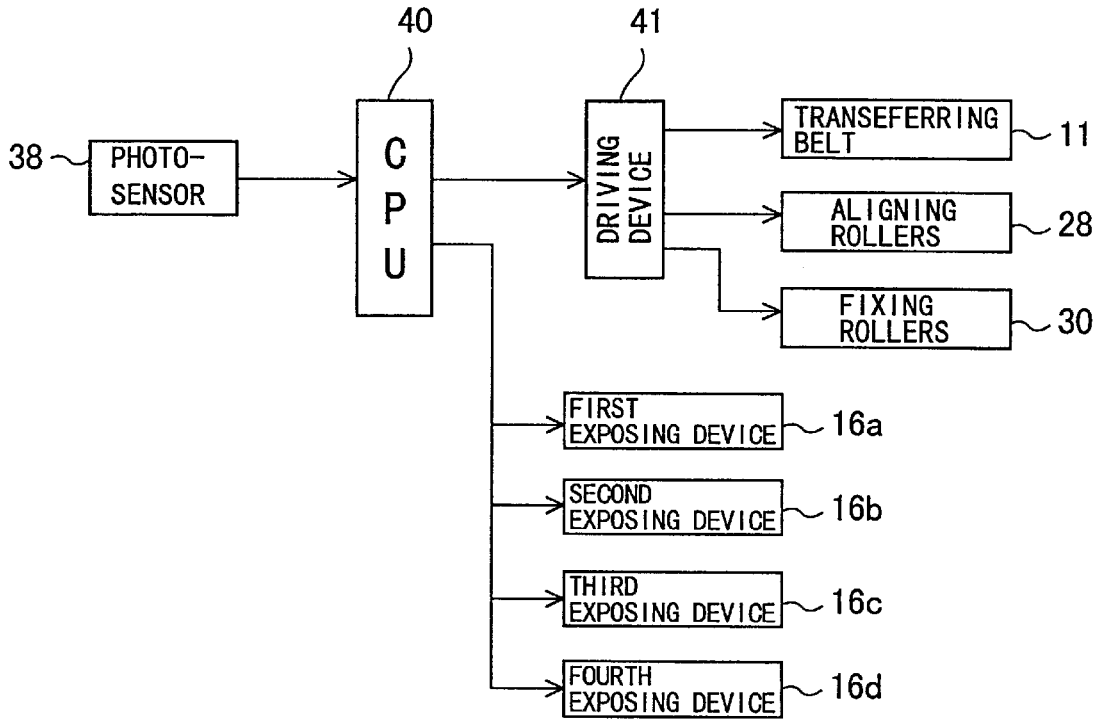
FIG. 4 is a block diagram schematically showing a control system to control a sheet of paper conveying speed applied to the embodiment of the present invention.

FIG. 4 is a block diagram showing a control system to control the sheet of paper conveying speeds of the transferring belt 11, the aligning rollers 28 and the fixing rollers 30. The results of detection by the photo-sensor 38 are input to a CPU 40. According to the results of detection input from the photo-sensor 38 which read the color registration marks (not shown) printed on the transferring belt 11, the CPU 30 detects the distortion of positions of transferred images for every image forming units 13*a*–13*d*, feeds the results of detection back to the exposing devices 16*a*–16*d* of the image forming units 13*a*–13*d*, controls the exposing timings and prevents the color distortion of a full color image.

Further, according to the results of detection by the photo-sensor 38 which read the belt registration marks 42, 43 printed on the transferring belt 11, the first sheet of paper registration marks 46, 47 and the second sheet of paper registration marks 48, 49, the CPU 40 controls a driving device 41 according to a difference in conveying speeds of the transferring belt 11, the aligning rollers 28 or the fixing rollers 30 obtained from the detected results and feedback controls the sheet of paper conveying speeds of the aligning rollers 28 or the fixing rollers 30.

Next, the sheet of paper conveying speed feedback control method of the aligning rollers 28 or the fixing rollers 30 will be described in detail. This conveying speed control is executed, for instance, when manufacturing a color printer, a full color copying machine, etc. or when the speed of the transferring belt 11 is varied. Definitely, when power is applied to a color printer or a full color copying machine, etc., its internal temperature rises and the outer diameters of the driving roller 11*b* and the idling roller 11*a* of the transferring belt 11 and the aligning rollers 28 will change and so, after power is applied, the conveying speed is controlled at a prescribed timing, for instance, at every prescribed number of sheets or time and further, when parts relative to the speed change are exchanged.

Figure 5:
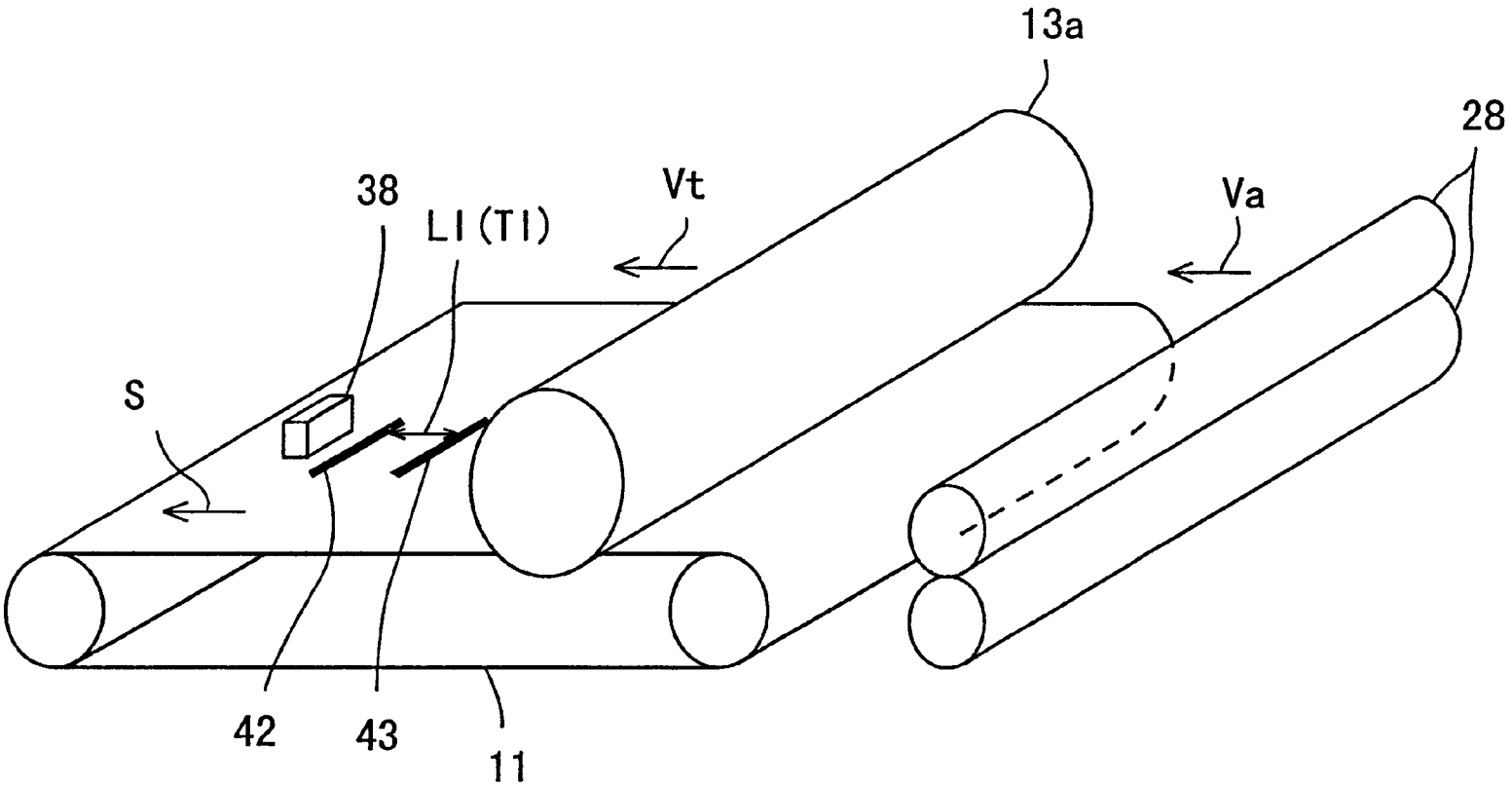
FIG. 5 is a perspective view schematically showing belt registration marks printed on a transferring belt applicable to the embodiment of the present invention.
Figure 6:
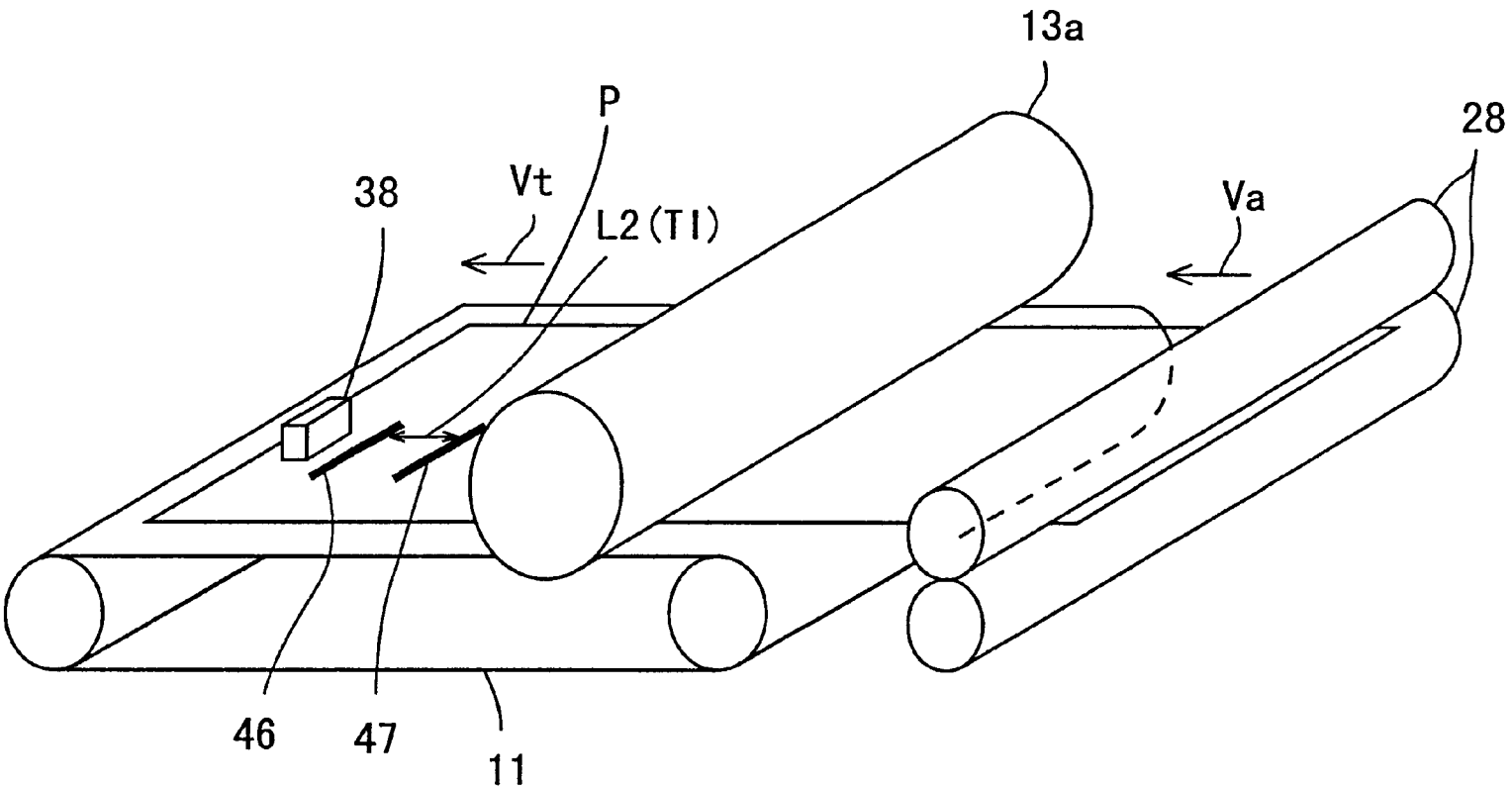
FIG. 6 is a perspective view schematically showing a first sheet of paper registration marks printed on a sheet of paper applied to the embodiment of the present invention.

Next, the feedback control method of the sheet of paper conveying speed of the aligning rollers 28 will be first explained. The belt registration marks 42, 43 that are the travelling inspection marks printed on the transferring belt 11 that is travelling in the arrow direction x shown in FIG. 5 and the first sheet of paper registration marks 46, 47 that are transferring material inspection marks printed on a sheet of paper P being conveyed in the arrow direction s on the transferring belt 11 by the conveying force of the aligning rollers 28 shown in FIG. 6, all of these registration marks are detected by the photo-sensor 38 and are input to the CPU 40. From these input results, the CPU 40 detects the passing times of the belt registration marks 42, 43 and the passing times of the registration marks of the first sheet of paper and calculates the sheet of paper conveying speeds of the transferring belt 11 and the aligning rollers 28, respectively. From the results of this calculation, the CPU 40 sends a feedback signal to the driving unit 41. Then, the driving unit 41 controls the sheet of paper conveying speed of the transferring belt 11 and the aligning rollers 28 so as to make the sheet of paper conveying speed of the transferring belt 11 and the aligning rollers 28 the same or to give a slight difference between them.

When described more in detail, under the state where the conveying speed Va of the aligning rollers 28 is set slower than the speed of the transferring belt 11, the belt registration marks 42, 43 and the first sheet of paper registration marks 46, 47 are printed using one of the image forming units 13*a*–13*d* at a prescribed time interval T1 on a sheet of paper P that is conveyed by the transferring belt 11 and the aligning rollers 28.

That is, it is assumed that the traveling speed of the transferring belt 11 was 100 mm/sec. and the conveying speed of the aligning rollers 28 was 80 mm/sec. Under this state, the belt registration marks 42, 43 in yellow (Y) is printed using, for instance, the first image forming unit 13*a* with the prescribed time interval T set at one sec. interval and similarly, the first sheet of paper registration marks 46, 47 in yellow (Y) is printed at one sec. interval on a sheet of paper P being conveyed by the aligning rollers 28. A space L1 between the belt registration marks 42, 43 on the transferring belt 11 is made to 100 mm, while the space L2 between the first sheet of paper registration marks 46, 47 on the sheet of paper P is made to 80 mm.

Thereafter, a time S of the belt registration marks 42, 43 to pass the photo-sensor 38 is detected and a time S2 of the first sheet of paper registration marks 46, 47 on the sheet of paper P being conveyed by the transferring belt 11 to pass the photo-sensor 38 after its trailing edge passed the aligning rollers 28 is detected. As a result, it is detected that a pass time S1 of the belt registration marks 42, 43 is one sec., and the time S2 of the first sheet of paper registration marks 46, 47 to pass the photo-sensor 38 is 0.8 sec. In other words, the paper conveying speed of the aligning rollers 28 becomes slow by 0.2 sec. because the passing time of the first sheet of registration marks 46, 47 detected by the photo-sensor 38 is faster by 0.2 sec. than the detected passing time of the registration marks 42,43 of the transferring belt 11.

Accordingly, the CPU 40 calculates that the travelling speed of the transferring belt 11 is 100 mm/sec. while the conveying speed of the aligning rollers 28 is as slow as 80 mm/sec. and the conveying speed difference is 20 mm/sec. From this result of calculation, the CPU 40 sends a feedback signal to the driving unit 41 to make the conveying speed of the aligning rollers 28 to the same as the transferring belt traveling speed 100 mm/sec. The driving unit 41 controls the conveying speed of the aligning rollers 28 to 100 mm/sec. by accelerating it by 20 mm/sec. that is a difference from the traveling speed of the transferring belt 11.

Figure 7:
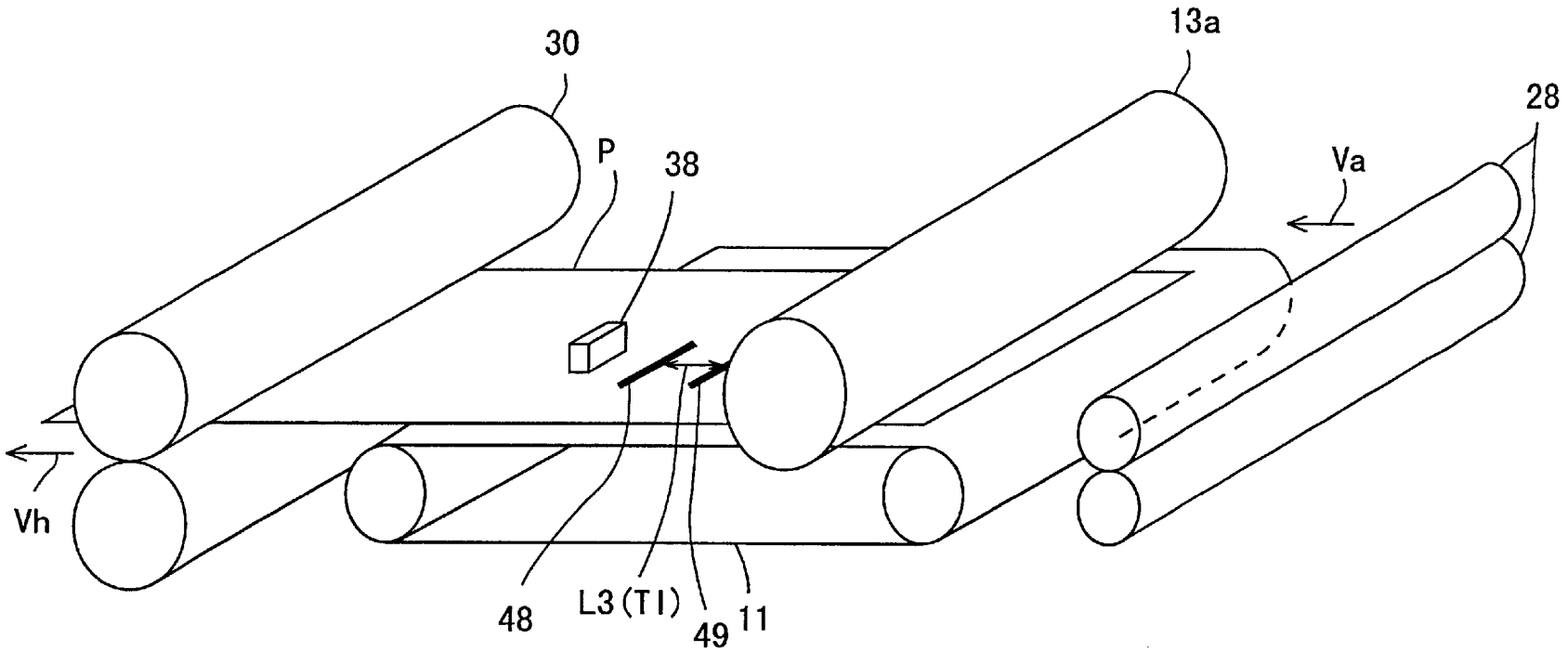
FIG. 7 is a perspective view schematically showing a second sheet of paper registration mark printed on a sheet of paper applied to the embodiment of the present invention.

Next, the feedback control method of the sheet of paper conveying speed of the fixing rollers 30 will be explained. When controlling the sheet of paper conveying speed, the inspection result of the second sheet of paper registration marks 48, 49 that are the transferring material inspection marks printed on a sheet of paper P being conveyed by the transferring belt 11 shown in FIG. 7 is further input to the CPU 40 by the photo-sensor 38.

From this input result, the CPU 40 detects a time to pass the second sheet of paper registration marks 48, 49 in addition to a time to pass the belt registration marks 42, 43 and a time to pass the first sheet of paper registration marks 46, 47, by adding this detected passing time to the above-mentioned sheet of paper conveying speeds of the transferring belt 11 and the aligning roller, calculates the sheet of paper conveying speed of the fixing rollers 30 and sends a feedback signal to the driving unit 41. The driving unit 41 controls the sheet of paper conveying speed of the fixing rollers 30 to the same as the sheet of paper conveying speed of the transferring belt 11 and the aligning rollers 28 or give a very few speed difference.

Definitely, the conveying speed Vh of the fixing rollers 30 is first set at a speed faster than the conveying speed Vt of the transferring belt 11. Assume that the conveying speed of the fixing rollers 30 was 120 mm/sec. against the conveying speed 100 mm/sec. of the transferring belt 11. Under this state, the second sheet of paper registration marks 48, 49 shown in FIG. 7 are printed on a sheet of paper P being conveyed by the transferring belt 11 using, for instance, the first image forming unit 13*a* with the prescribed time interval T1 set at 1 sec. As a result, a space L3 between the second sheet of paper registration marks 48, 49 is made 100 mm.

Then, after the sheet of paper P was conveyed by the transferring belt 11, a time S3 of the second sheet of paper registration marks 48, 49 printed on the sheet of paper P inserted and conveyed between the fixing rollers 30 to pass the photo-sensor 38 is detected. As a result, 5/6 sec. is detected as the time S3 of the second sheet of paper registration marks 48, 49 to pass the photo-sensor 38.

Accordingly, while the transferring speed of the transferring belt 11 is 100 mm/sec., the conveying speed of the fixing rollers 30 is as fast as 120 mm/sec. and it is calculated that a conveying speed difference is 20 mm/sec.

From this calculation result, the CPU 40 sends a feedback signal to the driving unit 41 to make the conveying speed of the fixing rollers 30 to the same as the traveling speed 110 mm/sec. of the transferring belt 11. The driving unit 41 controls the conveying speed of the fixing rollers 30 to 100 mm/sec. by decelerating it by 20 mm/sec. that is a conveying speed difference with the transferring belt 11.

Thus, after setting the aligning rollers 28, the transferring belt 11 and the fixing rollers 30 at the same speed of 100 mm/sec. by feedback controlling the aligning rollers 38 and the fixing rollers 30, the image forming operation in a color printer/a full color copying machine, etc. is started.

When starting the image formation, the driving of the image forming units 13*a*–13*d* is started, the photo-conductive drums 12*a*–12*d* are rotated in the arrow direction r and uniformly electrified by the charging rollers 14*a*–14*d* and then, applied with image data that is divided into yellow, red, blue and black by the exposing devices 16*a*–16*d* and electrostatic latent images in respective colors are formed. Further, the electrostatic latent images formed on the photo-conductive drums 12*a*–2*d* are developed with yellow (Y), red (R), cyan (C) and black (BK) developers by the developing devices 17*a*–17*d*, and after toner images in respective colors are formed, these toner images are transferred in order on a sheet of paper P conveyed on the transferring belt.

On the other hand, a sheet of paper P is taken out of the paper feed cassette 23 or the manual feed tray 26 by the pickup roller 24 or 27 and conveyed to the position of the charge applying roller 18*a* of the transferring belt 11 synchronizing with a toner image formed on the photo-conductive drum 12*a* at the first image forming unit 13*a* by the aligning rollers 28. While the sheet of paper P is conveyed in the arrow direction s by the transferring belt 11, the yellow (Y) toner image formed on the photo-conductive drum 12*a* is transferred thereon. Then, the magenta (M) toner image formed on the photo-conductive drum 12*b* of the second image forming unit 13*b* is transferred on the sheet of paper P whereon the yellow (Y) toner image is already transferred by the charge applying roller 18*b* at the second image forming unit 13*b*.

Further, a cyan (C) toner image is transferred on the sheet of paper P by the charge applying roller 18*c* at the third image forming unit 13*c* and a black (BK) toner image is also transferred by the charge applying roller 18*d* at the fourth image forming unit 13*d*. Thus, the yellow (Y), magenta (M), cyan (C) and black (BK) toner images are multi-transferred on the sheet of paper P. Thereafter, the sheet of paper P is conveyed to the fixing rollers 30 via the transferring belt 11 and after a full color image is completed by heating and fixing the toner images, ejected on the receiving tray 31.

On the other hand, after transferring the toner images, the image forming units 13*a*–13*d* are placed in the state ready to form next images after cleaned by the cleaning devices 20*a*–20*d* and charge eliminated by the charge eliminating lamps 22*a*–22*d*, and the transferring belt 11 is cleaned by a blade cleaner 11*c*. Thereafter, the above image forming operations are repeated until the required number of sheets are reached.

Thus, when manufacturing a color printer, a full color copying machine, etc. or when starting the image forming operation or at a prescribed timing, the sheet of paper conveying speeds of the aligning rollers 28 and the fixing rollers 30 are detected by detecting the belt registration marks 42, 43 printed on the transferring belt 11, the first sheet of paper registration marks 46, 47 and the second sheet of paper registration marks 48, 49 printed on a sheet of paper P by the photo-sensor 38. Then, using this detected results, the feedback control of the aligning rollers 28 and the fixing rollers 30 is executed so that the sheet of paper conveying speeds of the transferring belt 11 and the fixing rollers 30 are brought to almost the same speed. Therefore, a sheet of paper can be prevented from being bent as a result of setting the sheet of paper conveying speed of the aligning rollers 28 faster than the transferring belt 11 or the poor transfer and color distortion caused from blurring or vibration can be prevented and a good transferred toner image is obtained and in turn, the quality of printed formed image is improved.

Furthermore, as the first sheet of paper registration marks 46, 47 and the second sheet of paper registration marks 48, 49 are printed on the same sheet of paper P, the sheet of paper conveying speeds of both the aligning rollers 28 and the fixing rollers 30 can be detected by checking only one sheet of paper P.

Further, for detecting the sheet of paper conveying speed of the aligning rollers 28 and the fixing rollers 30, the photo-sensor 38 which reads color registration marks for correcting position distortions of transferring images by the image forming units 13*a*–13*d* is also used and therefore, it becomes not necessary to install a new means for detecting the sheet of paper conveying speed.

Further, the present invention is not restricted to the above-mentioned embodiments but can be modified variously within the scope of the present invention. For instance, this image forming apparatus is not restricted to the color image formation only, and the traveling speed of the transferring belt and the speeds of the aligning rollers and the fixing rollers that are controlled to the same speed as the speed of the transferring belt are optional according to toner image forming speeds on the photo-conductive drums. Further, at the time of the feedback control for regulating the paper conveying speeds of the aligning rollers, the transferring belt and the fixing rollers to the same speed, the conveying speed of the transferring belt may be controlled according to the detecting results provided from the detecting means.

Further, in order to make the paper conveying speed from the aligning rollers to the fixing rollers constant, a conveying speed difference between the aligning rollers and the transferring belt is detected and after controlling the aligning rollers or the transferring belt by sending a feedback signal, the fixing rollers may be feedback controlled by detecting a conveying speed difference between the transferring belt and the fixing rollers. Further, a dedicated means may be provided for detecting the paper conveying speeds of the aligning rollers, the transferring belt and the fixing rollers without using the photo-sensor that is used for preventing the color distortion of images.

As described above, according to the present invention, the traveling inspection marks printed on the transferring belt and the transferring material inspection marks printed on a sheet or paper P are detected and from this detected results, a sheet of paper conveying speed difference is detected and using this paper conveying speed difference, the aligning rollers and fixing rollers are feedback controlled and the sheet of paper conveying speeds of the aligning rollers, the transferring belt and the fixing rollers are controlled to almost the same speed. Therefore, it becomes possible to prevent damage of a sheet of paper caused from a difference in the conveying speeds of the aligning rollers, the transferring belt and the fixing rollers or a poor image transfer caused from blurring or vibration at the time of transfer, a good transferred color toner image without color distortion is obtained and in turn, the quality of the formed image can be improved.

What is claimed is:

1. An image forming apparatus comprising:

image forming means for forming a developer image on an image carrier;

image transferring means for transferring the developer image developed on the image carrier on an image receiving material;

travelling means for conveying the image receiving material toward the image carrier;

aligning means for conveying the image receiving material to the travelling means synchronizing with the transfer of the developer image formed on the image carrier;

fixing means for fixing the developer image on the image receiving material while conveying the image receiving material which already has the developer image transferred;

writing means for writing at least two inspection marks on the travelling means with a prescribed time difference provided between them and also writing at least two inspection marks on the image receiving material being conveyed by the aligning means with the same time difference as the prescribed time difference provided between them;

detecting means for detecting an inspection mark written on the travelling means and an inspection mark written on the image receiving material; and drive control means for controlling the drive of at least one of the travelling means, aligning means and fixing means.

2. An image forming apparatus according to claim 1, wherein the detecting means detects a difference between a time to detect a second of the inspection mark after detecting a first of the inspection mark written on the traveling means when the traveling means is traveling at a prescribed speed and a time to detect a second of the inspection mark after detecting a first of the inspection mark written on the image receiving material when the traveling means is conveying the image receiving material at the prescribed speed.

3. An image forming apparatus according to claim 2, wherein the drive control means detects a difference between the image receiving material conveying speed of the aligning means and the traveling speed of the traveling means using the above detected time difference.

4. An image forming apparatus according to claim 1, wherein the detecting means detects a difference between a time to detect a second of the inspection mark after detecting a first of the inspection mark written on the traveling means when the traveling means is traveling at a prescribed speed and a time to detect a second of the inspection mark after detecting a first of the inspection mark written on the image receiving material when the fixing means is conveying the image receiving material at the prescribed speed.

5. An image forming apparatus according to claim 4, wherein the drive control means detects a difference between the image receiving material conveying speed of the fixing means and the traveling speed of the traveling means using the above detected time difference.

6. An image forming apparatus comprising:

plural image carriers;

image forming means for forming developer images in different colors on the plural image carriers, respectively;

image transferring means for transferring the developer images formed in different colors on the plural image carriers, respectively on image receiving material by superposing each other in order;

travelling means conveying the image receiving material toward the image carriers;

aligning means for conveying the image receiving material to the traveling means synchronizing with the transfer of the developer images formed on the image carriers;

fixing means for fixing a developer image on the image receiving material while conveying the image receiving material which already has a developer image transferred;

writing means for writing a prescribed inspection mark on the traveling means and the image receiving material conveyed by the aligning means using the image forming means;

detecting means for detecting the inspection mark written on the traveling means and the inspection mark written on the image receiving material; and drive control means for controlling the drive of at least one of the traveling means, aligning means and fixing means.

7. An image forming apparatus comprising:

an image forming unit to form a developer image on a photo-conductive drum;

a transferring device to transfer the developer image formed on the photo-conductive drum on an image receiving material;

a transferring belt that is traveling to convey the image receiving material to the photo-conductive drum;

an aligning roller to convey the image receiving material to the transferring belt synchronizing with the transfer of the developer image formed on the photo-conductive drum;

a fixing roller to fix the developer image on the image receiving material while conveying the image receiving material that has the developer image transferred thereon;

a writing device to write at least two inspection marks on the transferring belt with a prescribed time difference provided between them, and write at least two inspection marks on the image receiving material being conveyed by the aligning roller with the same prescribed time difference as the time difference provided between them;

a sensor to detect the inspection marks written on the transferring belt and the inspection marks written on the image receiving material; and a drive control device to control the drive of at least one of the transferring belt, the aligning roller and the fixing roller according to the result of detection by the sensor.

8. An image forming apparatus according to claim 7, wherein the sensor detects a difference between a time to detect a second of the inspection mark after detecting a first of the inspection mark written on the transferring belt when the transferring belt is traveling at a prescribed speed and a time to detect a second of the inspection mark after detecting a first of the inspection mark written on the image receiving material when the transferring belt is conveying the image receiving material at the prescribed speed.

9. An image forming apparatus according to claim 8, wherein the drive control device detects a difference between the image receiving material conveying speed of the aligning roller and the traveling speed of the transferring belt using the detected time difference.

10. An image forming apparatus according to claim 7, wherein the sensor detects a difference between a time to detect a second of the inspection mark after detecting a first of the inspection mark written on the transferring belt when the transferring belt is traveling at a prescribed speed and a time to detect a second of the inspection mark after detecting a first of the inspection mark written on the image receiving material when the fixing roller is conveying the image receiving material at a prescribed speed.

11. An image forming apparatus according to claim 10, wherein the drive control device detects a difference between the image receiving material conveying speed of the fixing roller and the traveling speed of the transferring belt using the detected time difference.

12. An image forming apparatus comprising:

plural photo-conductive drums;

an image forming unit to form developer images in different colors on the plural photo-conductive drums, respectively;

a transferring device to transfer the developer images formed in different colors on the plural photo-conductive drums, respectively on image receiving materials by superposing each other in order;

a transferring belt to convey the image receiving materials to the photo-conductive drums;

an aligning roller to convey the image receiving materials to the transferring belt synchronizing with the transfer of the developer images formed on the photo-conductive drums;

a fixing roller to fix the developer images on the image receiving materials while conveying the image receiving material that has the developer images transferred thereon;

a writing device to write a prescribed inspection mark on the transferring belt and the image receiving material that is conveyed by the aligning roller;

a sensor to detect the inspection mark written on the transferring belt and the inspection mark written on the image receiving material; and a drive control device to control the drive of at least one of the transferring belt, the aligning roller and the fixing roller according to the result of detection by the sensor.

13. A sheet of paper conveying speed control method in an mage forming unit, comprising the steps of:

traveling a first conveying means to convey an image receiving material toward the image carriers at a prescribed speed;

feeding the image receiving material to the first conveying means while conveying the image receiving material at a prescribed speed by a second conveying means;

further conveying the image receiving material conveyed by the first conveying means by a third conveying mean;

writing a prescribed Conveying inspection mark on the first conveying means;

writing a prescribed image receiving material inspection mark on the image receiving material that is fed by the second conveying means;

detecting the conveying inspection mark written on the first conveying means;

detecting the image receiving material inspection mark written on the image receiving material; and controlling at least one of the traveling speed of the first conveying means, the image receiving material conveying speed of the second conveying means and the conveying speed of the third conveying means based on the detection result of the conveying inspection mark and the detection result of the image receiving material inspection mark.

14. A sheet of paper conveying speed control method in an image forming apparatus according to claim 13, wherein the step of writing the conveying inspection mark writes at least two conveying inspection marks on the first conveying means with a prescribed time difference while the first conveying means is traveling at the prescribed speed, the step of writing the image receiving material inspection mark writes at least two image receiving material inspection marks on the image receiving material that is being conveyed by the second conveying means with the same time difference as the prescribed time difference, the step of detecting the conveying inspection mark detects at least two conveying inspection marks written on the first conveying means in order while the first conveying means is traveling at the prescribed speed, the step of detecting the image receiving material inspection mark detects at least two image receiving material marks written on the image receiving material while the image receiving material is being conveyed by the first conveying means at the prescribed speed, and the step of controlling controls at least one of the traveling speed of the first conveying means and the image receiving material conveying speed of the second conveying means using a time difference between the detection of a second of the conveying inspection mark after a first of the conveying inspection mark in the conveying inspection mark detection and a time difference between the detection of a second of the image receiving material inspection mark after the detection of a first of the image receiving material inspection mark in the image receiving material inspection mark detection.

15. A sheet of paper conveying speed control method in an image forming apparatus according to claim 13, wherein the step of writing the conveying inspection mark writes at least two conveying inspection marks on the first conveying means with a prescribed time difference while the first conveying means is traveling at the prescribed speed, the step of writing the image receiving material inspection mark writes at least two image receiving material inspection marks on the image receiving material that is being conveyed by the second conveying means with the same time difference as the prescribed time difference, the step of detecting the conveying inspection mark detects at least two conveying inspection marks written on the first conveying means in order while the first conveying means is traveling at the prescribed speed, the step of detecting the image receiving material inspection mark detects at least two image receiving material marks written on the image receiving material while the image receiving material is being conveyed by the third conveying means at the prescribed speed, and the step of controlling controls at least one of the traveling speed of the first conveying means, the image receiving material conveying speed of the second conveying means and the conveying speed of the third conveying means using a time difference between the detection of a second of the conveying inspection mark after a first of the conveying inspection mark in the conveying inspection mark detection and a time difference between the detection of a second of the image receiving material inspection mark after the detection of a first of the image receiving material inspection mark in the image receiving material inspection mark detection.

* * * * *